US007260469B2

(12) United States Patent
Birk et al.

(10) Patent No.: US 7,260,469 B2
(45) Date of Patent: Aug. 21, 2007

(54) METHOD FOR OPERATING AN INTERNAL COMBUSTION ENGINE

(75) Inventors: Manfred Birk, Oberriexingen (DE); Jens Damitz, Illingen (DE); Juergen Moessinger, Weinsberg-Wimmental (DE); Michael Kessler, Weissach (DE); Vincent Dautel, Stuttgart (DE); Nicole Kositza, Gerlingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 11/501,531

(22) Filed: Aug. 8, 2006

(65) Prior Publication Data

US 2007/0050124 A1 Mar. 1, 2007

(30) Foreign Application Priority Data

Aug. 23, 2005 (DE) ..... 10 2005 039 757

(51) Int. Cl.
*F02D 41/00* (2006.01)

(52) U.S. Cl. ..... 701/111; 123/435

(58) Field of Classification Search ..... 701/111, 701/102, 101, 115; 123/435
See application file for complete search history.

(56) References Cited

U.S. PATENT DOCUMENTS 4,892,074 A * 1/1990 Iriyama ..... 123/406.22
5,245,969 A * 9/1993 Nishiyama et al. ..... 123/435
5,339,784 A * 8/1994 Fukui ..... 123/406.52
5,722,359 A * 3/1998 Chubachi et al. ..... 123/192.2

FOREIGN PATENT DOCUMENTS

DE 102 27 279 1/2004

* cited by examiner

*Primary Examiner*—Hieu T. Vo
(74) *Attorney, Agent, or Firm*—Kenyon & Kenyon LLP

(57) ABSTRACT

In a method for operating an internal combustion engine, a first data quantity is derived based on a signal of a first sensor which detects the pressure in a first combustion chamber of a plurality of combustion chambers, and a second data quantity is derived based on a signal of a second sensor, which second data quantity is a function of the pressure variation in at least one of the plurality of combustion chambers. The first data quantity and the second data quantity are functions of the pressure variation in the same combustion chamber, and a drift of the second sensor is ascertained from a change over time in the second data quantity with respect to the first data quantity.

14 Claims, 4 Drawing Sheets

METHOD FOR OPERATING AN INTERNAL COMBUSTION ENGINE

FIELD OF THE INVENTION

The present invention relates to a method for operating an internal combustion engine, as well as to a computer program and a control device for implementing the method.

BACKGROUND INFORMATION

In a method for operating an internal combustion engine described in published German patent document DE 102 27 279, a pressure sensor which detects the pressure in a cylinder (guide cylinder) of the engine is associated with this cylinder. Furthermore, the engine has a structure-borne noise sensor, which indirectly detects the pressure changes in the individual cylinders. The pressure variation plays an important role in combustion control according to this known method: the agreement of the detected combustion chamber pressure with the combustion chamber pressure obtained from the signal of the structure-borne noise sensor is verified for the guide cylinder. If, during a certain period of time, the ascertained pressures differ by more than a certain value, an error message is output, which informs the engine's user of a certain wear condition.

An object of the present invention is to provide a method in which the engine performance quantities required for combustion control or regulation may be ascertained economically, yet precisely.

SUMMARY

In connection with the present invention, it is recognized that certain "second" sensors such as structure-borne noise sensors have a lower accuracy, and are subject to greater tolerances and more drift (due to their underlying principle) than pressure sensors, while they are relatively cost-effective and simple to install. When the method according to the present invention is used, a drift of such a (second) sensor may be not only reliably recognized, but also quantified and subsequently compensated for. The performance quantities that are important for the control and regulation of the engine, such as the start of combustion, the center of gravity of the combustion, the gas torque, the maximum pressure, the indicated work, etc., may be determined using the second sensor with a similarly high accuracy as there may be by using the first (pressure) sensor, and this is largely independent of the operating time or the age of the sensors. This allows reliable and precise operation of the engine despite the use of the relatively economical second sensor.

In accordance with the present invention, a joint evaluation of the signal of the first sensor and the signal of the second sensor for a certain shared combustion chamber is carried out. A certain magnitude of the particular signal is advantageously used for evaluation, for example, the position, a crank angle, a maximum gradient, and/or a maximum value. In a simple case, the shared combustion chamber may be the combustion chamber whose pressure is directly detected by the first sensor. The corresponding cylinder is referred to, in general, as the guide cylinder. The precondition for this operation is that the second sensor, for example, a structure-borne noise sensor, is reliably reached by the structure-borne noise generated in the guide cylinder.

A drift-compensated second sensor, i.e., its signal, may in turn be used as reference for the drift compensation of a third sensor. Also in this case, the precondition is that the signals or quantities of both sensors should be referable to the same combustion chamber. In this way, if necessary, an entire chain of drift compensations may be performed, starting with a pressure signal-based drift compensation. Using a single pressure sensor, this allows drift-compensated operation of a plurality of other sensors, which in turn make precise control or regulation of the engine possible.

Another advantageous variant of the method may be used when the specific arrangement of the second sensor makes it impossible to associate the quantity, already provided by it, with the guide cylinder or a cylinder whose pressure behavior is being detected by an already drift-compensated second sensor. For this case, it is proposed that the first quantity be simply phase shifted by the crank angle distance between the guide cylinder and a cylinder or combustion chamber whose pressure behavior is being-detected by the second sensor which is to be drift-compensated.

The precondition for carrying out this method, however, is for the pressure variation in the combustion chamber of the guide cylinder to be essentially equal to that in the combustion chamber to which the second quantity provided by the second sensor refers. This is the case, e.g., in overrun operation of the engine, where no combustion takes place in the combustion chamber and where the pressure variation therefore depends essentially on the normal piston compression in the combustion chamber.

Another operating state in which such a drift recognition is possible is the "conventional" operation of a diesel engine in which only a slight exhaust gas recirculation takes place, which results in a short ignition delay in all cylinders. As a result, the differences in the charges of the individual cylinders have only a slight effect on the combustion angle and thus on the variation of combustion pressure. In addition, it is advantageous for recognizing the drift of the second sensor if known methods are used in this operating state for equalizing the injection amount differences, for example, on the basis of the engine speed signal.

By comparing all characteristic curves measured using the second sensor, further interfering factors of the individual cylinders, caused, for example, by different injection behaviors, may be largely eliminated by the drift compensation.

An additional correction may also be performed in the "partially homogeneous" operation. However, in this case the air differences of the individual cylinders have an additional effect. These differences should be detected, if possible, via suitable measures for reducing the (interfering) effects. If necessary, an air amount correction may also be performed using the combustion angles of those cylinders which have already been ascertained using drift-compensated auxiliary sensors.

If the second sensor is reliably affected by the pressure variation in two adjacent combustion chambers, the above-described method, in which the first quantity is phase shifted, may be performed for both combustion chambers, and a mean value may be formed from the two ascertained drifts. The accuracy of this method is enhanced in this way.

The method according to the present invention is based on ascertaining a change over time in the second quantity with respect to the first quantity. The initial or reference state is therefore a state in which it is assumed that a drift of the second sensor does not yet exist. To have maximum flexibility in a later drift compensation, it is advantageous if, in order to define the reference state, the ratio of the first quantity to the second quantity is determined in several different operating states of the engine, and this ratio is used to establish a reference characteristic curve. The drift of the second sensor then results from the distance of the second quantity ascertained at a later point in time from this characteristic curve for the same first quantity situated on the characteristic curve.

DETAILED DESCRIPTION

Figure 1:
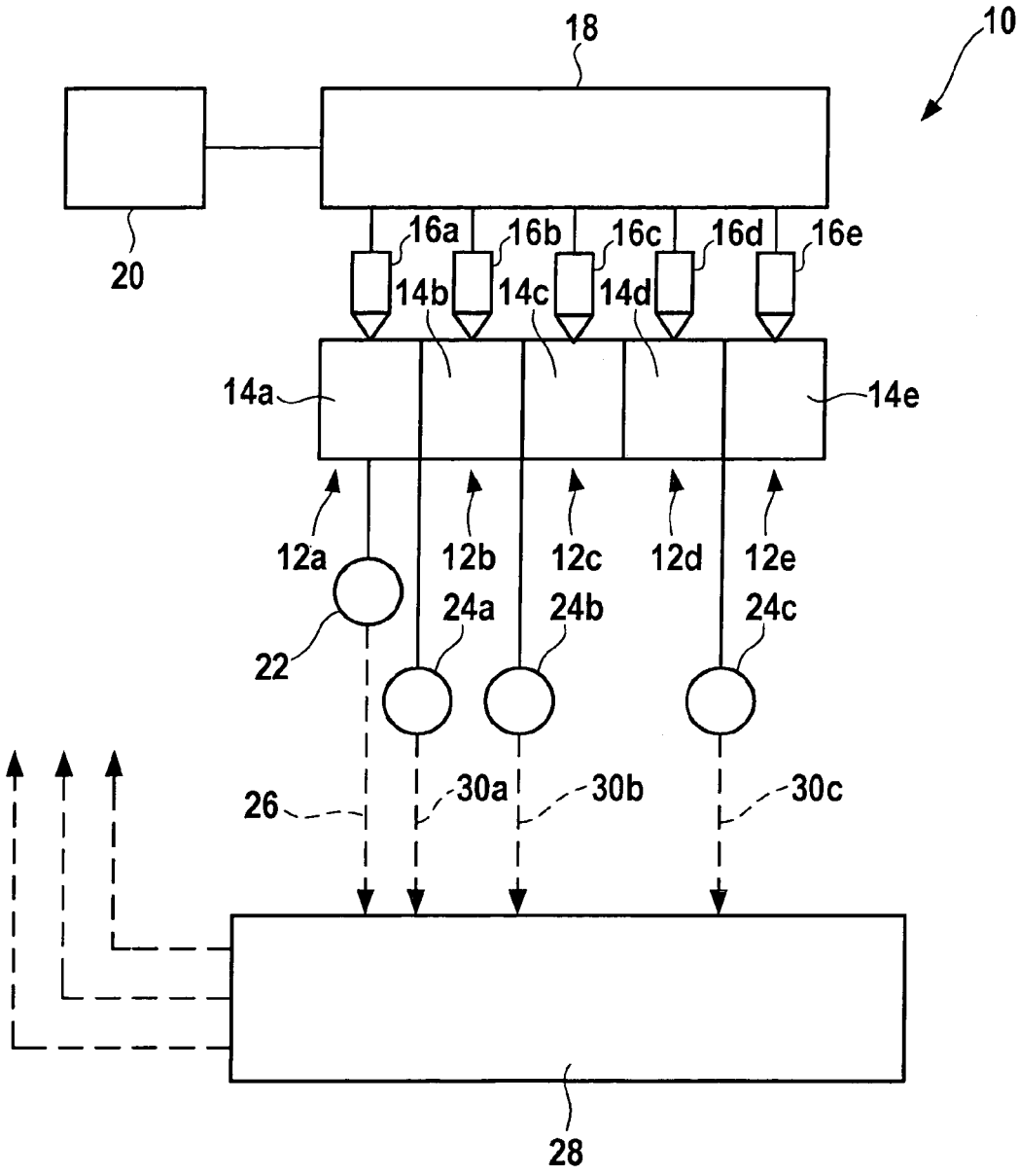
FIG. 1 shows a schematic block diagram of an internal combustion engine having a plurality of combustion chambers, one pressure sensor, and a plurality of structure-borne noise sensors.

An internal combustion engine, which is generally identified by numeral 10 in FIG. 1, includes a total of five cylinders 12*a*, 12*b*, 12*c*, 12*d*, and 12*e*, which have the respective combustion chambers 14*a*, 14*b*, 14*c*, 14*d*, and 14*e*. Fuel is directly injected into combustion chambers 14*a*-14*e* via respective injectors 16*a*-16*e*, which are connected to a shared fuel high-pressure accumulator (rail) 18, which in turn is supplied with fuel by a high-pressure pumping system 20.

The pressure in combustion chamber 14*a* of cylinder 12*a* designated as guide cylinder is detected directly by a first sensor, namely a pressure sensor 22. A second sensor, designed as a structure-borne noise sensor 24*a*, is situated between cylinders 12*a* and 12*b*. There is a further sensor, designed as a structure-borne noise sensor 24*b*, between cylinders 14*b* and 14*c*, and a third structure-borne noise sensor 24*c* is situated between cylinders 12*d* and 12*e*. Pressure sensor 22 delivers a pressure signal 26 to a control and regulating unit 28. In a similar manner, structure-borne noise sensors 24*a* through 24*c* deliver structure-borne noise signals 30*a* through 30*c* to control and regulating unit 28.

Pressure signal 26 and structure-borne noise signals 30*a* through 30*c* are analyzed, and the start of combustion, the center of gravity of combustion, the gas torque, the maximum pressure, the indicated work, and other engine performance quantities relevant for the current combustion in individual combustion chambers 14*a* through 14*e* are ascertained in control and regulating unit 28. The variation of the corresponding pressure signal 26 is plotted against angle αKW of a crankshaft (not shown in FIG. 1) of engine 10 in FIG. 2. Structure-borne noise signal 30*a* generated by structure-borne noise sensor 24*a* during a combustion in combustion chamber 14*a* is plotted against angle αKW (crank angle) in FIG. 2.

Figure 2:
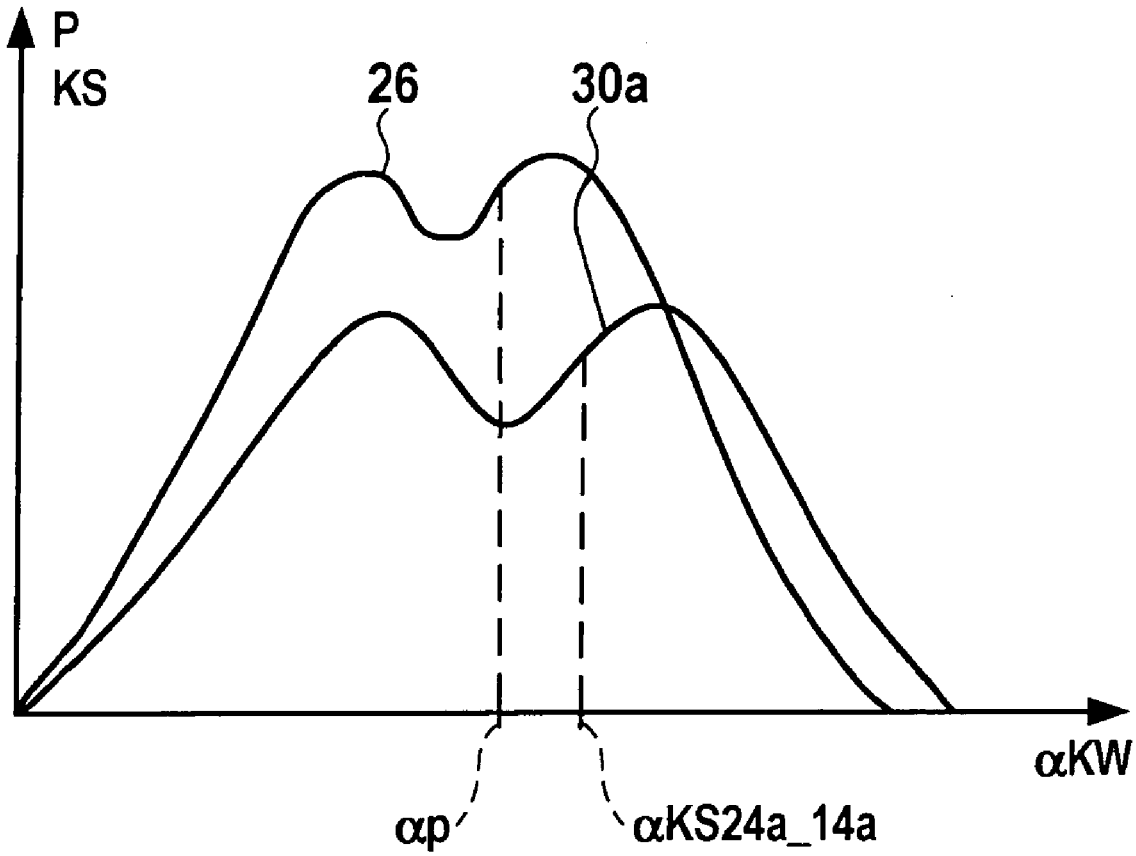
FIG. 2 shows a graph in which the signal of the pressure sensor of FIG. 1 and the signal of one of the structure-borne noise sensors of FIG. 1 are plotted against the angle of a crankshaft.

Curves 26 and 30*a* shown in FIG. 2 apply to a well-defined operating state of engine 10, at a well-defined point in time of fuel injection by injector 16*a*. Pressure signal 26 and structure-borne noise signal 30*a* have well-defined signal properties, i.e., "magnitudes," for example, the position defined by the crank angle of a range having a maximum gradient. This maximum gradient occurs, for pressure signal 26, at a crank angle αP, and for structure-borne noise signal 30*a*, at a crank angle αKS24*a*_14*a*. Crank angle αP is designated as the first quantity, and crank angle αKS24*a*_14*a* as the second quantity.

In a state of engine 10 in which it may be assumed that structure-borne noise sensors 24*a* through 24*c* have not yet aged and thus have no drift, the properties of the signals at crank angles αP and αKS24*a*_14*a*, shown in FIG. 2, are detected for different operating states of the engine, i.e., among other things, at different triggering points of injector 16*a*.

Figure 3:
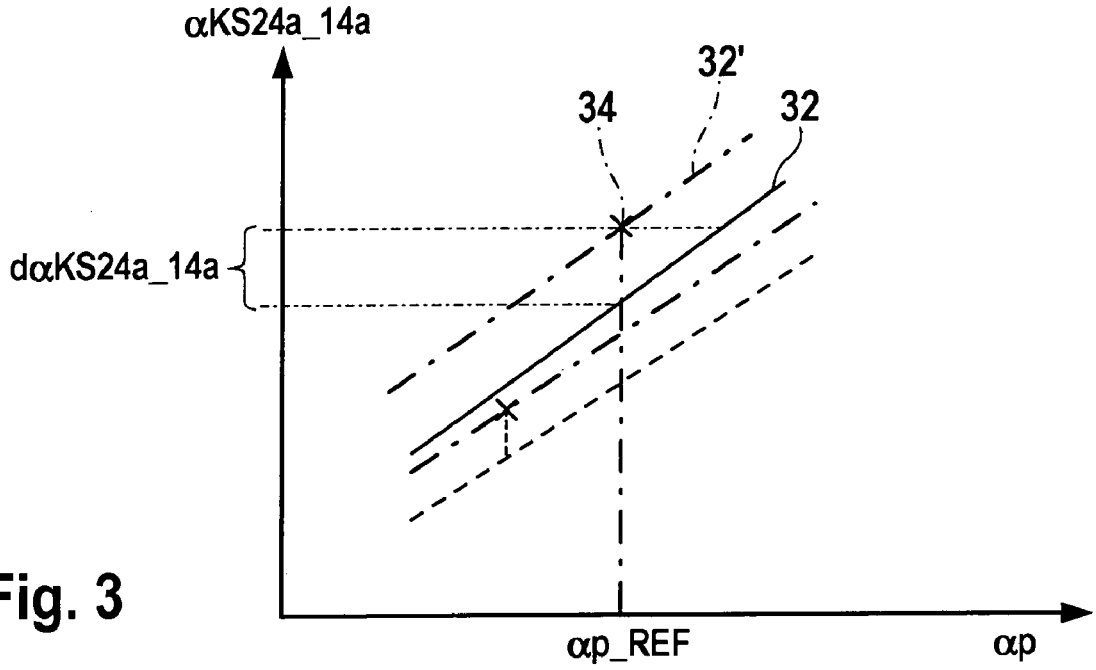
FIG. 3 shows a graph in which a first quantity based on the signal of the pressure sensor of FIG. 1 is plotted against a second quantity based on the signal of a structure-borne noise sensor of FIG. 1 at two separate points in time, in accordance with a first implementation of the drift compensation method according to the present invention.

In this way, a reference characteristic curve may be established which links first quantity αP and second quantity αKS24*a*_14*a*. This characteristic curve is depicted in FIG. 3 and is labeled by reference numeral 32. Structure-borne noise sensor 24*b* also detects structure-borne noise triggered by the combustion in combustion chamber 14*a*. Therefore, a characteristic curve, which is, however, only drawn in FIG. 3 as a dashed line and is not provided with a reference numeral, may also be established for this structure-borne noise sensor 24*b*. As is apparent from FIG. 3, the characteristic curves of structure-borne noise sensors 24*a* and 24*b* do not coincide due to the different transmission paths and also due to the different properties of structure-borne noise sensors 24*a* and 24*b*. Of course, the characteristic curves, for example, first characteristic curve 32, may also be stored as formulas.

During operation of engine 10, quantities αKS24*a*_14*a* and αP are also detected and a check is made as to whether or not the pair of values thus defined is still on the characteristic curve 32. As soon as the corresponding pair of values (reference numeral 34 in FIG. 3) is off the characteristic curve 32 in one or more reference states, this means that second quantity αKS24*a*_14*a* has changed with respect to first quantity αP: specifically, for constant first quantity $\alpha_{PREF}$, second quantity αKS24*a*_14*a* changes by a difference dαKS24*a*_14*a*. This is interpreted as a drift of second sensor 24*a* and compensated for by a shift of first characteristic curve 32 by drift dαKS24*a*_14*a*. The drift-compensated first characteristic curve is labeled by reference numeral 32' in FIG. 3.

Figure 4:
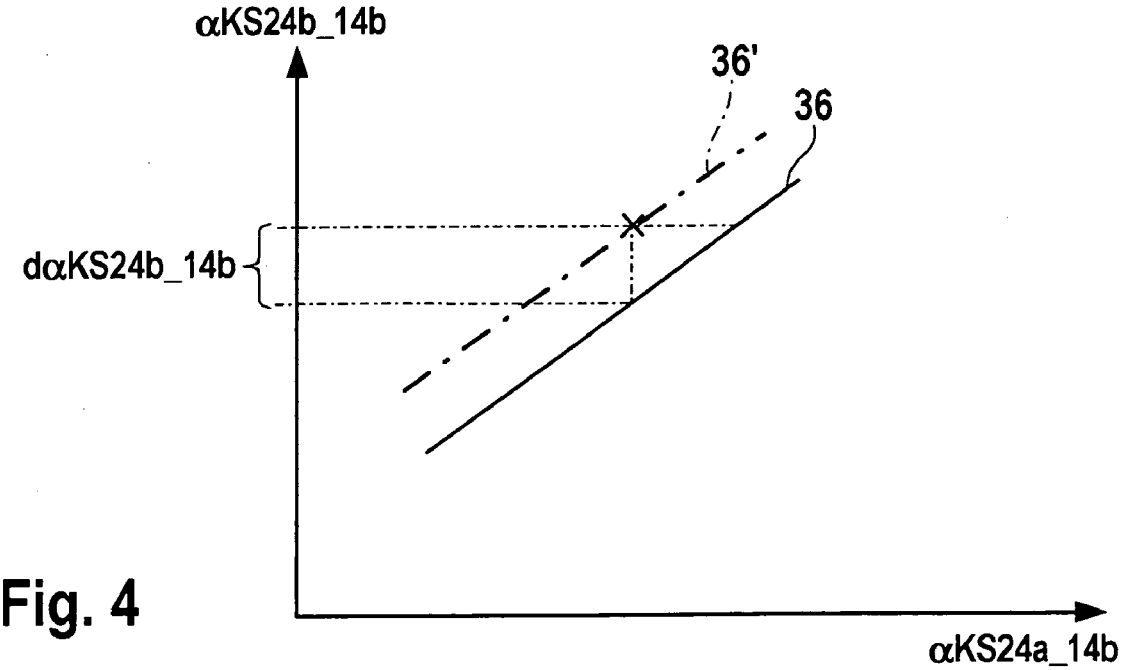
FIG. 4 shows a graph in which a fourth quantity based on the signal of a structure-borne noise sensor is plotted against a third quantity based on the signal of a drift-compensated structure-borne noise sensor at two separate points in time, in accordance with a second implementation of the drift compensation method according to the present invention.

A similar procedure is followed for structure-borne noise sensor 24*b* ("third sensor"), drift-compensated structure-borne noise sensor 24*a* being used as reference (FIG. 4). Initially, at a first point in time where structure-borne noise sensors 24*a* and 24*b* still have no drift, at different operating states of engine 10, crank angle αKS24*a*_14*b* at which the structure-borne noise caused at structure-borne noise sensor 24*a* due to a combustion in combustion chamber 14*b* having maximum gradient is ascertained as the "third quantity." The same procedure is carried out for signal 30*b* of structure-borne noise sensor 24*b*, whereby a corresponding "fourth quantity" αKS24B_14*b* is obtained. These two quantities are linked in the form of a characteristic curve 36, as shown in FIG. 4.

In further operation at later points in time, quantities αKS24*a*_14*b* and αKS24*b*_14*b* are detected again in one or more reference states, the drift compensation previously explained in FIG. 3 being performed for the third quantity. If there is a difference dαKS24*b*_14*b* during the operation of engine 10, this is recognized as a drift of second structure-borne noise sensor 24*b* and a new, drift-compensated characteristic curve 36' is formed. This procedure makes it possible to iteratively compensate all those structure-borne noise sensors 24*a* through 24*c* which, together with at least one drift-compensated structure-borne noise sensor 24*a* through 24*c*, are able to evaluate the combustion angle of a cylinder 12, for example.

Figure 5:
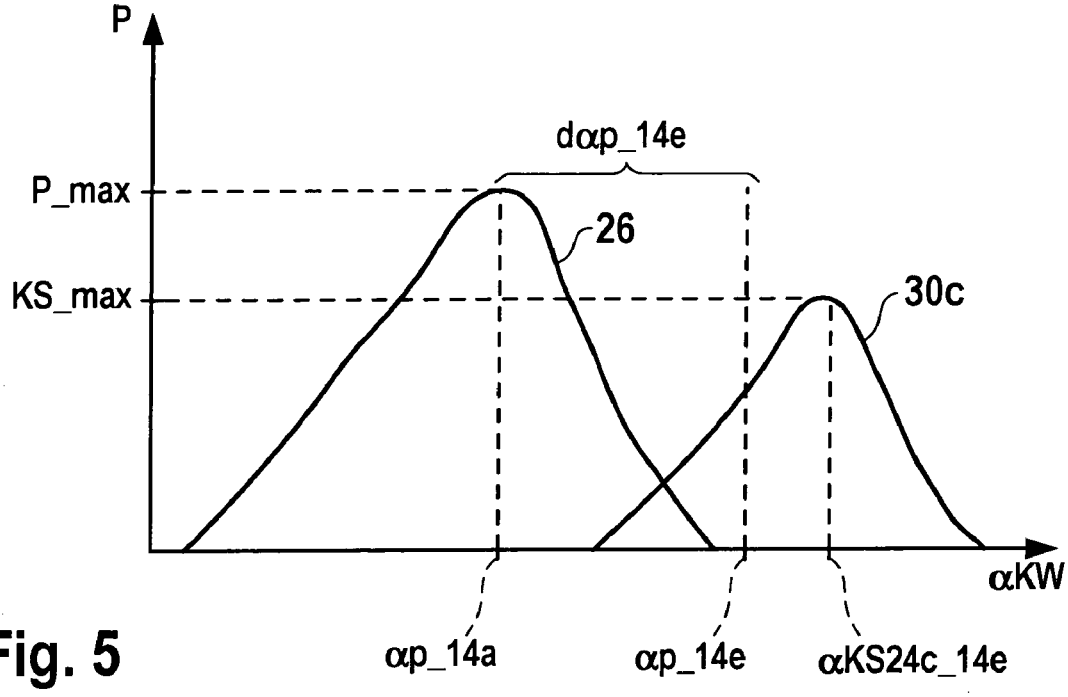
FIG. 5 shows a graph similar to the graph shown in FIG. 2, for illustrating a third implementation of the drift compensation method according to the present invention.
Figure 6:
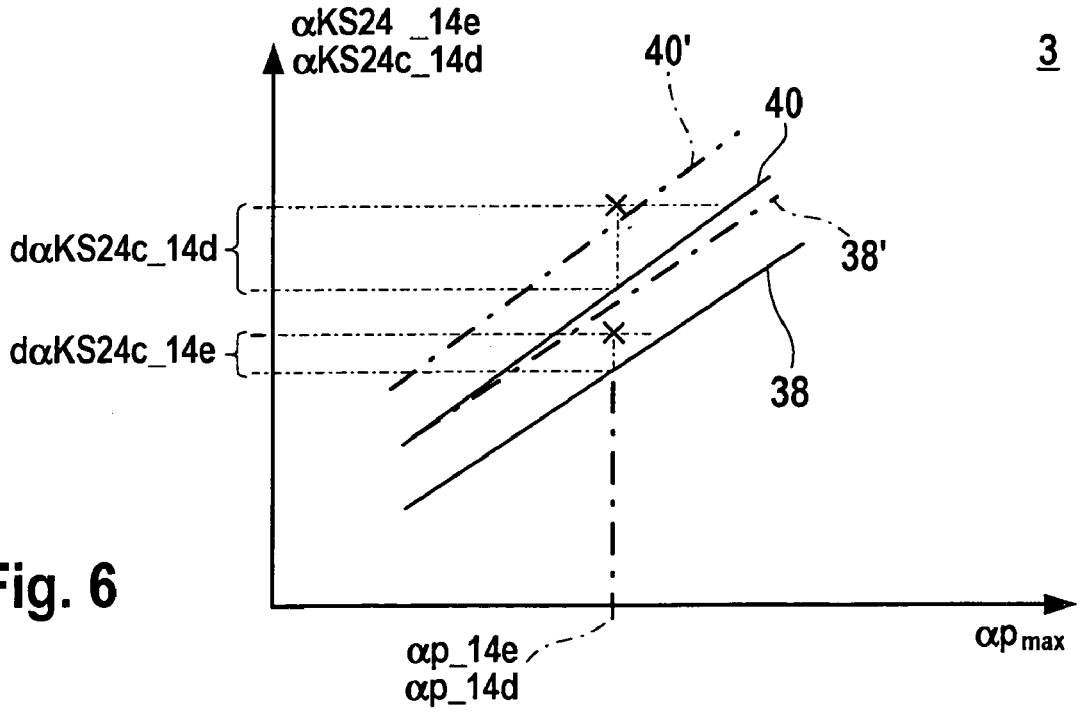
FIG. 6 shows a graph similar to the graph shown in FIG. 3 for illustrating the third implementation of the drift compensation method according to the present invention.

Another procedure for drift compensation is now explained with reference to FIGS. 5 and 6. It is used for drift compensation of structure-borne noise sensor 24*c*. Since it is situated between the two combustion chambers 14*d* and 14*e*, it detects equally the structure-borne noise originating from both combustion chambers 14*d* and 14*e*. In an overrun operation of the engine, in which no fuel is injected into combustion chambers 14, and therefore also no combustion takes place, at the beginning of the overall operating time of engine 10, when it may be assumed that structure-borne noise sensors 24*a* through 24*c* have no drift, position αKS24*c* of the signal maximum detected by structure-borne noise sensor 24*c* for both combustion chambers 14*d* and 14*e* (this is depicted in FIG. 5 for combustion chamber 14*e* as an example (signal maximum KS_max for a crank angle αKS24*c*_14*e*)) and the position of a corresponding pressure maximum P_max based on pressure signal 26 are ascertained in the same combustion chambers 14*d* and 14*e* (in FIG. 5 labeled αP_14*e* for combustion chamber 14*e*). However, since the pressure is not directly detected by pressure sensor 22 either in combustion chamber 14*d*or in combustion chamber 14*e*, position αP_14*a* of the pressure maximum detected by pressure sensor 22 in combustion chamber 14*a* is simply phase shifted here by a crank angle distance dαP_14*e* (for combustion chamber 14*e*). This crank angle distance dαP_14*e* corresponds to the crank angle distance between combustion chamber 14*a* and combustion chamber 14*e*.

In this way, position αP_14*e* of pressure maximum P_max, referred to combustion chamber 14*e* and detected by pressure sensor 22, is obtained. Together with position αKS24*c*_14*e* of the maximum pressure detected by structure-borne noise sensor 24*c*, it is used, in the case of combustion chamber 14*e*, for forming a reference characteristic curve 38 (see FIG. 6). A similar procedure is followed for combustion chamber 14*d*, resulting in a similar reference characteristic curve 40. In further operation of engine 10, quantities αP and quantities αKS24*c*_14*d* and αKS24*c*_14*e*, referred to combustion chambers 14*d* and 14*e*, are further detected.

The value pairs obtained move away from the corresponding reference characteristic curves 38 and 40 via a drift. Thus, for example, in the present exemplary embodiment, after a certain time it is determined in one or more reference states that, for example, for combustion chamber 14*e*, a position of maximum KS_max of structure-borne noise signal 30*c* is detected for a certain position αP_14*e* of the phase-shifted pressure signal maximum of structure-borne noise sensor 24*c*, which is shifted from reference characteristic curve 40 by a difference dαKS24*c*_14*e*. Similarly, a shift dαKS24*c*_14*d* results for combustion chamber 14*d*. A mean value is now formed from the two shifts dαKS24*c*_14*d* and dαKS24*c*_14*e*, and is assumed to be the actual drift of structure-borne noise sensor 24*c*. Drift-compensated new characteristic curves 38' and 40' similarly result (FIG. 6).

It is understood that the above-named three procedures for drift compensation of structure-borne noise sensors 24*a* through 24*c* may be performed in any desired combination, which considerably increases the accuracy in ascertaining the compensation. In addition, it should be mentioned that, as in the previously mentioned exemplary embodiments, the differences obtained over time with respect to a reference state were used for the drift compensation. However, it is also possible to perform the drift compensation in a regulated (i.e., closed-loop controlled) operation instead of an (open-loop) controlled operation, in which an appropriate manipulated variable, obtained to maintain said differences at zero, is used for ascertaining the drift. If the manipulated variable deviates from zero, a drift may be inferred.

What is claimed is:

1. A control device for controlling an operation of an internal combustion engine, comprising:

a calculation unit for deriving:

a first data quantity which is based on a signal of a first sensor, wherein the first sensor detects a pressure in a first combustion chamber of a plurality of combustion chambers; and a second data quantity which is based on a signal of at least one second sensor, wherein the second data quantity is a function of a pressure variation in at least one of the plurality of combustion chambers;

wherein both the first data quantity and the second quantity are one of: a) a function of a pressure variation in the same combustion chamber, and b) related to the same combustion chamber, and wherein a drift of the at least one second sensor is ascertained from a change over time of the second data quantity with respect to the first data quantity.

2. A computer-readable storage medium for storing a computer program that controls, when executed by a computer, an operating method of an internal combustion engine, the method comprising:

providing a first data quantity which is based on a signal of a first sensor, wherein the first sensor detects a pressure in a first combustion chamber of a plurality of combustion chambers; and providing a second data quantity which is based on a signal of at least one second sensor, wherein the second data quantity is a function of a pressure variation in at least one of the plurality of combustion chambers;

wherein both the first data quantity and the second quantity are one of: a) a function of a pressure variation in the same combustion chamber, and b) related to the same combustion chamber, and wherein a drift of the at least one second sensor is ascertained from a change over time of the second data quantity with respect to the first data quantity.

3. A method for operating an internal combustion engine, comprising:

providing a first data quantity which is based on a signal of a first sensor, wherein the first sensor detects a pressure in a first combustion chamber of a plurality of combustion chambers; and providing a second data quantity which is based on a signal of at least one second sensor, wherein the second data quantity is a function of a pressure variation in at least one of the plurality of combustion chambers;

wherein both the first data quantity and the second quantity are one of: a) a function of a pressure variation in the same combustion chamber, and b) related to the same combustion chamber, and wherein a drift of the at least one second sensor is ascertained from a change over time of the second data quantity with respect to the first data quantity.

4. The method as recited in claim 3, wherein the second data quantity is a function of the pressure in the first combustion chamber.

5. The method as recited in claim 4, further comprising:

compensating the ascertained drift of the at least one second sensor;

providing a third data quantity which is based on a signal of the drift-compensated at least one second sensor, wherein the third data quantity is a function of a pressure variation in a second combustion chamber of the plurality of combustion chambers;

providing a fourth data quantity which is based on a signal of a third sensor, wherein the fourth data quantity is a function of the pressure variation in the second combustion chamber; and ascertaining a drift of the third sensor based on a change over time of the fourth data quantity with respect to the third data quantity.

6. The method as recited in claim 5, wherein at least one of the second and the third sensor is one of a structure-borne noise sensor and an ion current sensor.

7. The method as recited in claim 3, wherein the second data quantity is a function of a pressure in a second combustion chamber, and wherein the first data quantity is obtained by phase-shifting the signal of the first sensor by a crank angle difference between the first combustion chamber and the second combustion chamber, and wherein, in an operating state of the internal combustion engine in which the pressure variation in the first combustion chamber and the second combustion chamber is approximately the same, the drift of the at least one second sensor is ascertained from a change over time of the second data quantity with respect to the first data quantity.

8. The method as recited in claim 7, further comprising:

providing by the second sensor a third data quantity which is a function of a pressure in a third combustion chamber;

wherein the first data quantity is obtained by phase shifting the signal of the first sensor by a crank angle difference between the first combustion chamber and the third combustion chamber;

wherein, in an operating state of the internal combustion engine in which the pressure variation in the first combustion chamber and the third combustion chamber is approximately the same, a drift of the second sensor is ascertained from a change over time of the third data quantity with respect to the first data quantity; and wherein a mean value of the drift related to the second combustion chamber and the drift related to the third combustion chamber is ascertained.

9. The method as recited in claim 8, wherein the operating state of the internal combustion engine, in which the pressure variation in the first combustion chamber and the second combustion chamber is approximately the same, is one of an overrun operation and a normal operation.

10. The method as recited in claim 9, wherein a fuel-injection method for equalizing injection-amount differences among the plurality of combustion chambers is implemented in the normal operation.

11. The method as recited in claim 7, wherein the operating state of the internal combustion engine, in which the pressure variation in the first combustion chamber and the second combustion chamber is approximately the same, is one of an overrun operation and a normal operation.

12. The method as recited in claim 11, wherein a fuel-injection method for equalizing injection-amount differences among the plurality of combustion chambers is implemented in the normal operation.

13. The method as recited in claim 3, wherein, for determining a change over time of the second data quantity with respect to the first data quantity, a reference state is defined, and wherein the reference state is determined from a reference characteristic curve which is defined by: a) detecting each of the first and second data quantities in at least two different operating states of the internal combustion engine; and b) and linking the detected first and second data quantities.

14. The method as recited in claim 13, wherein the first and second data quantities are defined by at least one of: a) a position of a maximum gradient on the reference characteristic curve; and b) a position of a maximum value on the reference characteristic curve.

* * * * *